US005353687A

United States Patent [19]

Koenig

[11] Patent Number: 5,353,687

[45] Date of Patent: Oct. 11, 1994

[54] POCKET CYLINDER FOR SLIDING DOOR

[76] Inventor: Larry E. Koenig, c/o Komar Industries, Inc. 4425 Marketing Pl., Groveport, Ohio 43125

[21] Appl. No.: 993,123

[22] Filed: Dec. 18, 1992

[51] Int. Cl.[5] ..... B65D 43/20; F01B 1/02

[52] U.S. Cl. ..... 92/61; 220/346; 92/146

[58] Field of Search ..... 92/61, 146, 161, 164, 92/165 R; 220/345, 346, 908

[56] References Cited

U.S. PATENT DOCUMENTS

| | | | |
|---|---|---|---|
| 1,626,968 | 5/1927 | Reckler | 92/146 X |
| 2,592,168 | 4/1952 | Morris et al. | 92/146 X |
| 3,127,817 | 4/1964 | Duner . | |
| 3,368,478 | 2/1968 | Clar | 92/61 X |
| 3,386,206 | 6/1968 | Loveless | 220/345 X |
| 3,514,902 | 6/1970 | Anderson | 220/345 X |
| 3,718,231 | 2/1973 | O'Connor | 220/345 X |
| 3,877,349 | 4/1975 | Schindel . | |
| 4,141,281 | 2/1979 | Harman et al. | 92/146 X |
| 4,624,512 | 11/1986 | Fay . | |
| 4,882,876 | 11/1989 | Daugirdas . | |
| 4,953,500 | 9/1990 | Savage-Rumbaugh et al. . | |
| 4,991,493 | 2/1991 | Loujus . | |

FOREIGN PATENT DOCUMENTS

| | | | |
|---|---|---|---|
| 217931 | 2/1909 | Fed. Rep. of Germany | 92/61 |
| 2526882 | 11/1983 | France | 92/146 |
| 2526883 | 11/1983 | France . | |

*Primary Examiner*—Edward K. Look
*Assistant Examiner*—John Ryznic
*Attorney, Agent, or Firm*—Thompson, Hine and Flory

[57] ABSTRACT

A compact hydraulic cylinder for use in a recess of a sliding door of a waste processing system. The cylinder includes a housing containing a first cylinder rod extending from one end of the housing and second and third rods extending from an opposite end of the housing and spaced apart such that the first rod is located between the second and third rods. The first cylinder rod is adapted to be connected to a fixed mounting bracket located on the waste processing system and the second and third cylinder rods are adapted to be connected to a removable mount. The removable mount is also located in the recess and is adapted to be connected to the door such that the mount and cylinder assembly can be accessed from the rear of the door without having to disassemble the door.

20 Claims, 5 Drawing Sheets

POCKET CYLINDER FOR SLIDING DOOR

BACKGROUND OF THE INVENTION

This invention relates to hydraulic cylinders and, more particularly, to cylinders for use in mechanical systems having confined areas, or where reduced cylinder size is desired.

In mechanical systems where limited space is available for an actuating hydraulic cylinder, three basic methods of reducing the space occupied by the cylinder have commonly been applied. One method includes the use of a telescoping cylinder, which is a cylinder having multiple rods extending in one direction having progressively smaller diameters so that the rods can be contained within one another. Inherent disadvantages associated with telescoping cylinders is that because the cylinders are contained within one another, the outermost cylinder can be quite large in diameter. Consequently, the use of this type of cylinder is unavailable for systems where an extremely limited space is available. Telescoping cylinders are also difficult to seal because of their complex design, they require a large number of seals. Furthermore, besides being very costly, telescoping cylinders are very weak in the retract mode.

A second method commonly utilized for actuating hydraulic cylinders in confined areas is by using two opposing cylinders with housing connected together in a side by side arrangement wherein the cylinder rods extend in opposite directions. This method has also proven to be ineffective because opposing cylinders with housings connected together produce an undesirable rotating torque when the cylinders are actuated. Additionally, if the cylinder rods are placed in parallel to one another rather than in an aligned arrangement, an undesirable bending moment is applied to the rods.

A third method for actuating hydraulic cylinders in a limited space is by mounting the cylinders at an angle skewed from the actual direction of mechanism actuation, such as in a criss-cross mount or scissors arrangement. Criss-cross and scissors assemblies, however, have a variety of inherent problems with limited stroke capability, inconsistent forces throughout the stroke, and undesirable high loads on mechanism joints. Therefore, a need exists for an improved hydraulic cylinder that eliminates the problems associated with previous cylinder designs, which can be utilized in mechanical systems where limited space is available and which are easy to install and maintain.

SUMMARY OF THE INVENTION

The present invention is a compact hydraulic cylinder having an arrangement of three double-acting hydraulic cylinders encased in a unitary housing such that a first cylinder rod extends from one end of the housing and second and third cylinder rods extend from an opposite end of the housing. The first cylinder rod extends from the center of the housing and the second and third cylinder rods are spaced apart such that the first cylinder rod is located between the second and third rods.

The housing is a single rectangular cylinder block, with two end caps, which provides the shortest assembly possible for a given stroke. Since each cylinder rod has half the total stroke required for the assembly, the cylinder rods can be of a smaller diameter than would be required for a single cylinder with the same total stroke.

The second and third cylinder rods are linked to one another with a center bar of a removable mount, causing the rods to actuate synchronously. These paired cylinders eliminate the rotating torque caused by similarly actuating opposing cylinders wherein the housings are connected together.

When the cylinder is assembled into a mechanism such as a sliding door or ram of a waste processing system having a recess shaped to receive the cylinder, the single center rod is connected to a stationary mount attached to the waste processing system housing. The removable mount is also retained within the door recess and includes two side bars connected to the center bar. The entire housing and cylinder rods when completely retracted fit securely within the recess provided within the door or ram. The two side bars include ears to secure the mount and cylinder within the recess. The ears are pinned to the rear of the door so that the entire cylinder/removable mount assembly is removable from the rear of the door without requiring the removal of a cover plate on the door which seals the cylinder/-removable mount assembly.

In operation, the three cylinders are actuated to extend the rods, nearly tripling in length the cylinder to move the door to a closed position. When the cylinder rods are retracted, the cylinder pulls against the mount, which in turn transmits the force to the door itself, thereby sliding the door along the guides to an open position. The advantages of this design is that the arrangement of the three cylinders eliminates undesirable force couples and torque that would occur if only two opposing cylinders were used. Furthermore, the combination of the cylinder and the mount provides a door or ram actuating mechanism which is accessible through a single opening in the rear of the door or ram, thereby eliminating the need to access the front of the door or ram which is essential when used in a contaminated environment.

Accordingly, it is an object of the present invention to provide a hydraulic cylinder for a door or ram of a waste processing system which eliminates undesirable force couples and torque of previous cylinders; a hydraulic cylinder which applies constant forces during actuation; a hydraulic cylinder in which the cylinder rods actuate along substantially the entire length of the cylinder housing; a hydraulic cylinder which provides easy access to the cylinder from the rear of a door or ram; and a hydraulic cylinder which is easy to install and maintain.

These and other features and advantages of the present invention will be better understood by reference to the following detailed description, the accompanying drawings and the appended claims.

DETAILED DESCRIPTION

Figure 1:
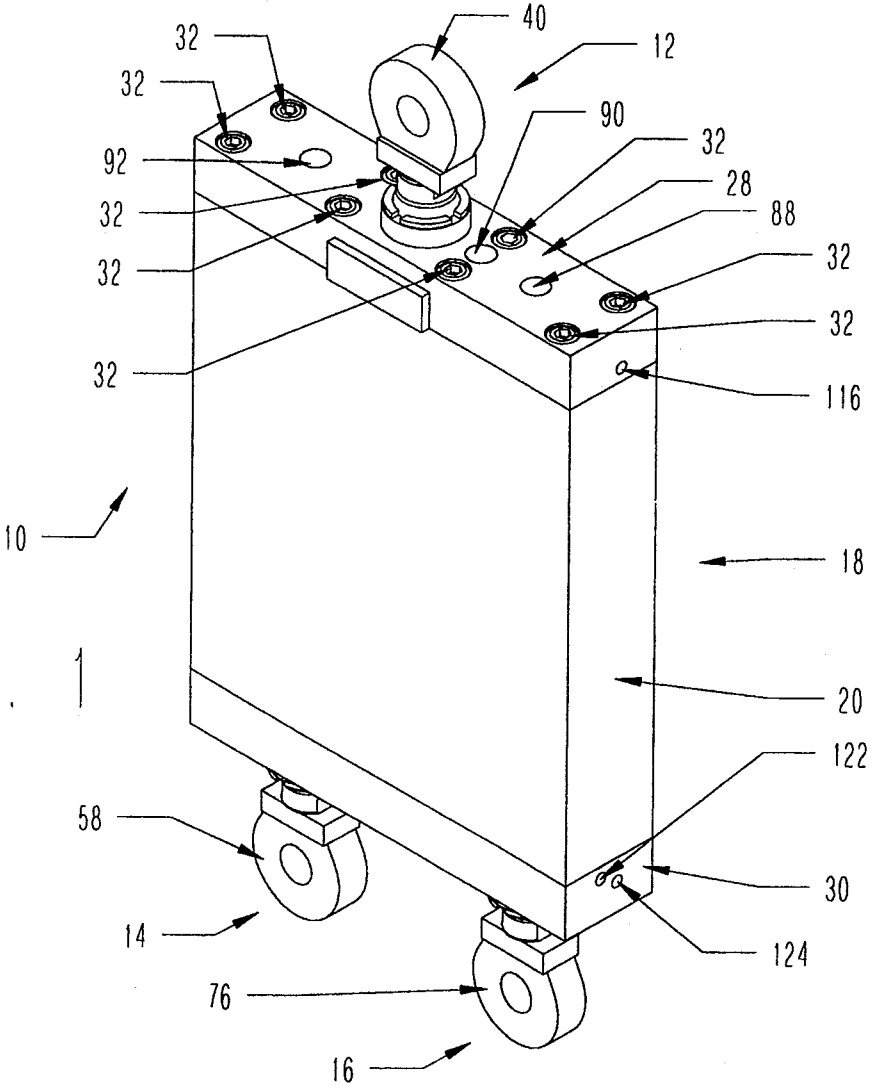
FIG. 1 is a perspective view of a pocket cylinder of the present invention.
Figure 2:
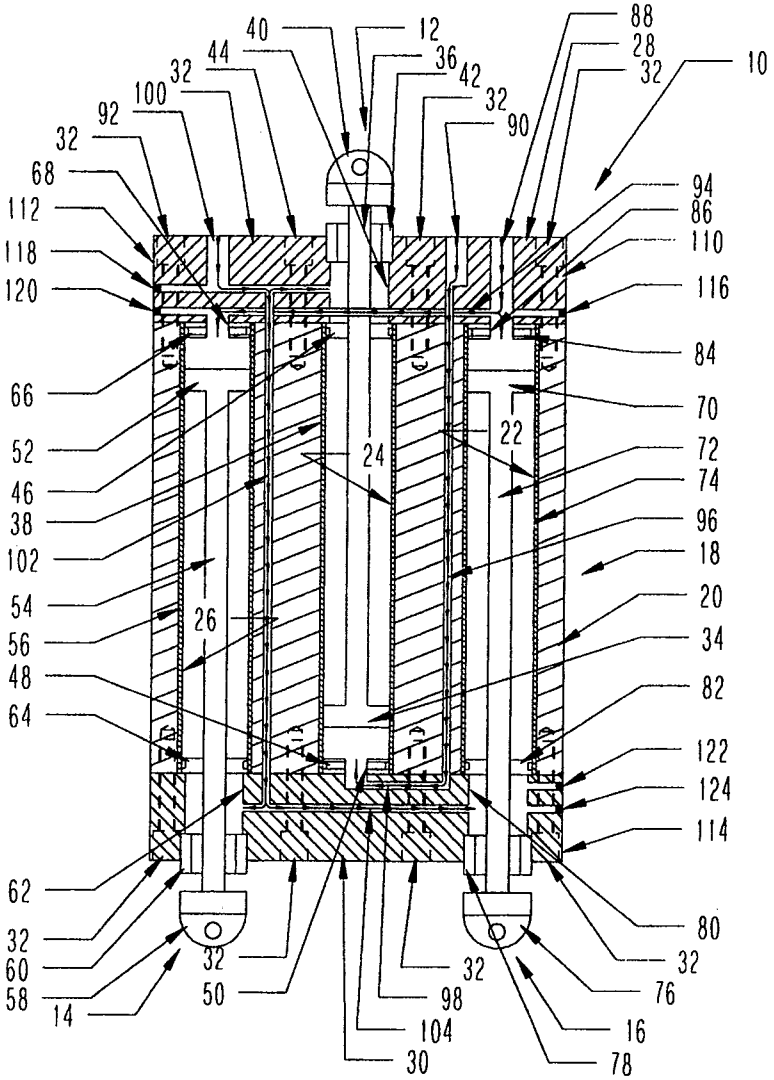
FIG. 2 is a cross sectional view of the pocket cylinder of FIG. 1.

A pocket cylinder, generally designated 10, of the present invention is shown in FIGS. 1 and 2, and includes an arrangement of three double-acting hydraulic cylinder units 12, 14 and 16 encased in a unitary housing 18. Housing 18 includes a central block 20 having three longitudinally-extending bores 22, 24, 26 oriented substantially parallel to each other. Bores 22–26 are enclosed by end caps 28, 30, which are retained by eight screws 32 passing through caps 28, 30 and into block 20.

Hydraulic cylinder unit 12 consists of a piston 34 attached to the lower end of a cylinder rod 36 which actuate within a cylinder tube 38 located within bore 24. On the opposite end of the cylinder rod 36 is a connector which is retained outside of end cap 28 by a collar 42. Cylinder rod 36 extends from a centrally located hole 44 passing through end cap 28. Hydraulic fluid is retained within cylinder tube 38 by gasket 46 connected to end cap 28 and gasket 48 connected to end cap 30. Gasket 48 includes a hole 50 for the passage of hydraulic fluid into cylinder tube 38.

Hydraulic cylinder units 14 and 16 are spaced apart within housing 18 such that cylinder unit 12 is located between them. Hydraulic cylinder unit 14 also comprises a piston 52 connected to the lower end of a cylinder rod 54. Piston 52 and cylinder rod 54 actuate within a cylinder tube 56 located in bore 26. Located on the opposite end of cylinder rod 54 is a connector 58 which is retained on the outside of end cap 30 by collar 60. Cylinder rod 54 extends through a hole 62 in end cap 30. Hydraulic fluid is retained within cylinder tube 56 by gasket 64 attached to end cap 30 and gasket 66 attached to end cap 28. Gasket 66 includes a hole 68 which allows hydraulic fluid to pass into cylinder tube 56.

Hydraulic cylinder unit 16 comprises a piston 70 connected to the lower end of a cylinder rod 72. Piston 70 and cylinder rod 72 actuate within a cylinder tube 74 located in bore 22. Located at the opposite end of cylinder rod 72 is a connector 76 which is retained on the outside of end cap 30 by collar 78. Cylinder rod 72 extends through a hole 80 passing through end cap 30. Hydraulic fluid is retained within cylinder tube 74 by gasket 82 attached to end cap 30 and gasket 84 attached to end cap 28. Gasket 84 includes a hole 86 which allows hydraulic fluid to enter cylinder tube 74.

End cap 28 includes three hydraulic fluid ports 88, 90, 92 which connect to hydraulic fluid lines (not shown) for passing hydraulic fluid to cylinder tubes 38, 56, 74. Fluid port 88 extends through end cap 28 and communicates with hole 86 in gasket 84 to allow hydraulic fluid to enter into the top of cylinder tube 74. Fluid port 88 also communicates with passage 94 which extends horizontally through end cap 28 around hole 44 in end cap 28, and into hole 68 in gasket 66 for passage of hydraulic fluid into the top of cylinder tube 56. Fluid port 90 extends through end cap 28 and provides hydraulic fluid to the bottom of cylinder tube 38 by communicating with bore 96 which passes vertically through cylinder block 20 and into passage 98 in end cap 30. Passage 98 communicates with hole 50 in gasket 48 to allow the fluid to enter into cylinder tube 38.

Fluid port 92 provides hydraulic fluid to the top of cylinder tube 38 and to the bottom of both cylinder tubes 56, 74. Fluid port 92 provides fluid to tube 38 by communicating with passage 100 in end cap 28 which extends horizontally towards hole 44 in end cap 28. Fluid enters cylinder tube 38 through gasket 46. Fluid port 92 also communicates with bore 102 passing vertically through cylinder block 20 which communicates with passage 104 in end cap 30. Passage 104 extends horizontally in both directions to allow fluid to pass into holes 62, 80 in end cap 30. Hydraulic fluid enters cylinder tubes 56, 74 through gaskets 64, 82 respectively. Passages 94, 98, 100, 104 are formed in end caps 28, 30 by drilling through the sides 110, 112 and 114 of end caps 28, 30 which are subsequently sealed with plugs 116, 118, 120, 122, and 124.

Figure 3:
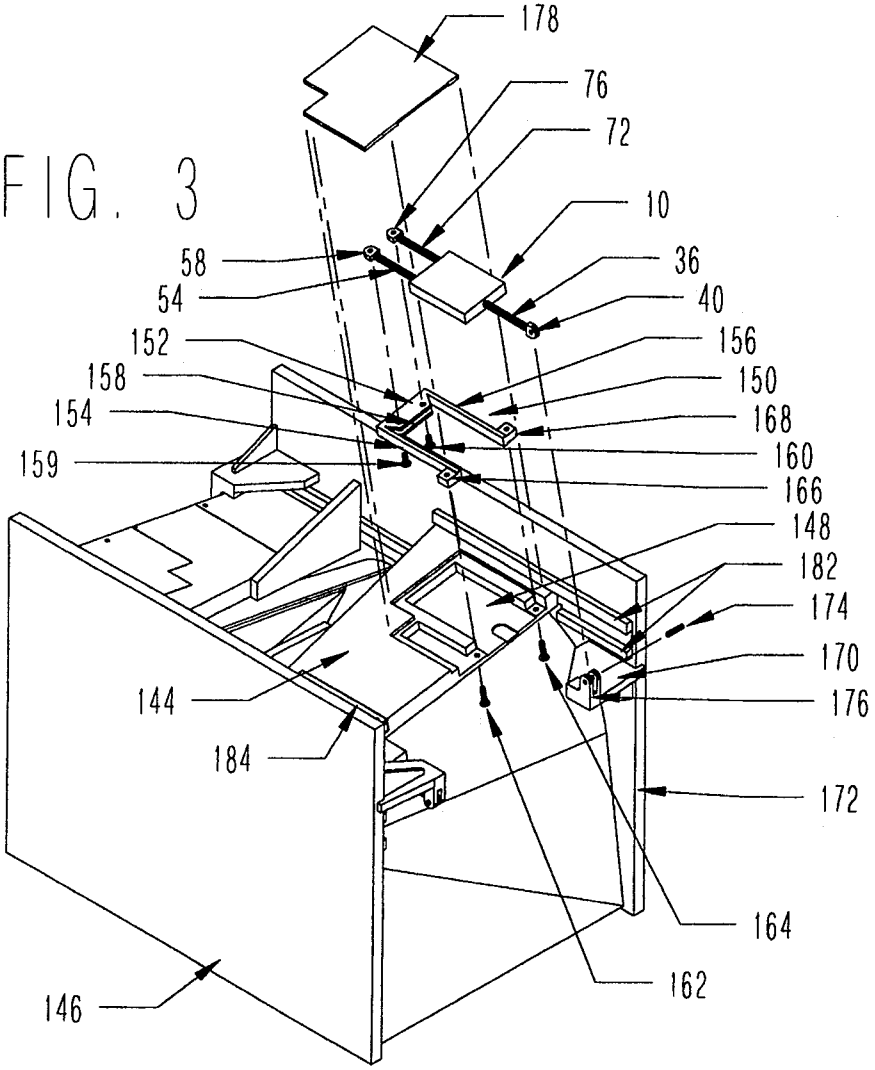
FIG. 3 is a perspective, partially exploded view of the pocket cylinder of FIG. 1 as incorporated into a sliding door of a waste processing system.
Figure 4:
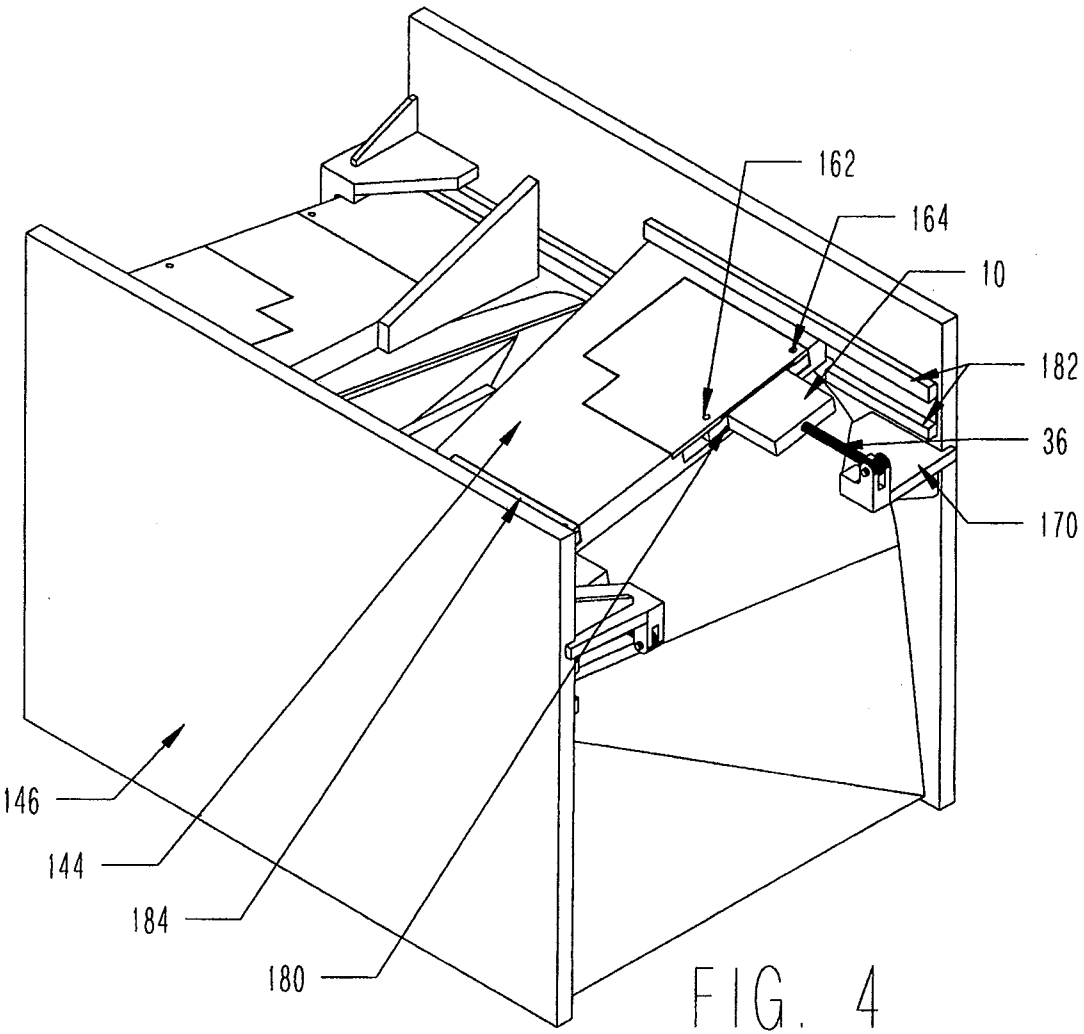
FIG. 4 is a perspective view of the pocket cylinder of FIG. 1 in the assembled condition illustrating the door in a closed position.

Connectors 40, 58 and 76 located at the ends of the cylinder rods attach the rods to a mechanical system. As shown in FIGS. 3 and 4, the pocket cylinder 10 is utilized to actuate a sliding door 144 of a waste processing system 146, such as the system shown in Koenig U.S. Pat. No. 4,938,426, but it is to be understood that the pocket cylinder 10 can be utilized for any mechanical system having a confined area or where reduced cylinder size is desired. As seen best in FIG. 3, the pocket cylinder 10 is mounted within a recess 148 shaped to receive the cylinder formed in sliding door 144. Specifically, cylinder rods 54, 72 are attached to a U-shaped mount 150 which consists of a center bar 152 and two side bars 154, 156. Center bar 152 includes a slot 158 in which connectors 58, 76 extend and are held in place by pins 159 and 160.

Mount 150 is also located in recess 148 and is connected to door 144 by pins 162, 164 which pass through the door 144 and into ears 166 and 168 located on the end of side bars 154, 156. Cylinder rod 35 is attached to a mounting bracket 170 that is rigidly attached to housing 172 of waste processing system 146. Cylinder 36 is connected to mounting bracket 170 by a pin 174 which passes through connector 40 retained within a groove 176 in bracket 170. Cover plate 178 is placed over recess 148 to protect the pocket cylinder 10 and mount 150 from any contamination that may be present in connection with the waste processing system 146. The combination of recess 148 and cover plate 178 form a socket 180 (as seen best in FIG. 4) in which pocket cylinder 10 may actuate.

The assembly of the pocket cylinder 10 and the mount 150 is removable from the rear of the door 144 without requiring the removal of the cover plate 178 which seals the mount 150. The mount and pocket cylinder assembly is easily accessible by removing pins 162, 164 which allows the cylinder and mount to be slid out of socket 180. By providing for removal of the cylinder from the rear of the door, replacing or maintaining the cylinder can be achieved without disassembling the entire door.

In operation, cylinder units 12, 14 and 16 are actuated to extend rods 36, 54 and 72, thereby tripling the cylinder in length to move the door 144 to a closed position. To open door 144, cylinder rods 36, 54 and 72 are retracted, thereby causing the pocket cylinder 10 to pull against center bar 152 and mount 174, which in turn transmits the force to the door 144 itself, thereby sliding the door along guides 182 and 184 located on either side of the door 144. During operation, as cylinder rod 36 extends, the door 144 and the cylinder block 20 move forward as a unit, while 50 percent of the total actuation distance has been achieved. When rods 54, 72 extend, the final 50 percent of the total actuation distance is achieved by pushing the door forward as the cylinder block 20 slides within pocket 180. During all aspects of operation of the pocket cylinder, the entire assembly remains firmly guided in a straight line.

Figure 5:
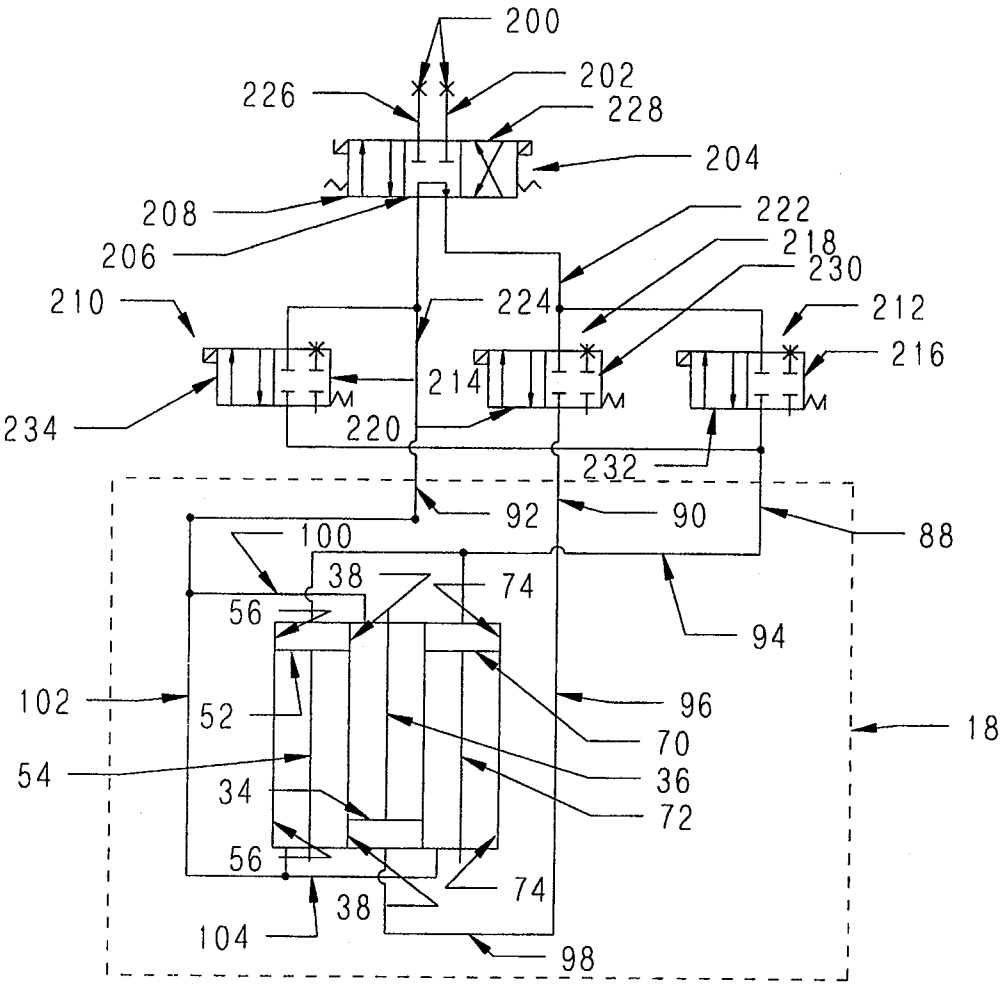
FIG. 5 is a schematic hydraulic circuit diagram for the cylinder of FIG. 1.

FIG. 5 is a hydraulic circuit diagram illustrating the actuation of cylinder rods 36, 54 and 72. To extend cylinder rod 36 while cylinder rods 54 and 72 remain stationary, hydraulic fluid is drawn from the reservoir 200 through the pressure hydraulic line 202 into a first control valve 204 which has been actuated from its closed position 206 to a first open position 208. The second control valve, 210 and third control valve 212 are held in their closed positions 214, 216 respectively while fourth control valve 218 is actuated to its open position 220. Hydraulic fluid passes into valve 218 through hydraulic line 222 and into cylinder tube 38 located in housing 18 through fluid port 32. Once in the housing 18, the fluid travels through bore 96 and passage 98 before entering cylinder tube 38. The hydraulic fluid exerts pressure against piston 34 which extends rod 36. As rod 36 extends forward, hydraulic fluid adjacent rod 36 exits tube 38 through passage 100 and out of housing 18 through fluid port 92. The evacuated fluid returns to the reservoir 200 through fluid line 244 and return line 226.

To retract cylinder rod 36, while retaining cylinder rods 54, 72 stationary, control valve 204 is activated to a second open position 228 which directs hydraulic fluid from pressure line 202 through hydraulic line 224 and into housing 18 through fluid port 92. The fluid then enters passage 100, and ultimately into cylinder tube 38. Once inside tube 38, the fluid exerts a downward force on piston 34, thereby retracting cylinder rod 36. Fluid below piston 36 exits cylinder tube 38 through passage 98 into bore 96, and out cylinder block 20 through fluid port 90. The evacuated fluid returns to the reservoir 200 through fluid line 222 and return line 226.

To extend cylinder rods 54 and 56 while retaining cylinder rod 36 stationary, control valve 204 is again actuated to position 208, while valves 210 and 218 are placed in their closed positions 214, 230 respectively. Valve 212 is actuated to its open position 232 which allows hydraulic fluid under pressure to enter housing 18 through fluid port 88 and into cylinder tubes 56, 74 via passage 94. The hydraulic fluid exerts pressure on pistons 52, 70 to extend cylinder rods 54, 72 respectively. Hydraulic fluid adjacent cylinder rods 54, 72 exits the cylinder tubes 56, 74 through passage 104 and bore 102 before exiting the housing 18 through fluid port 92. The fluid returns to reservoir 224 through lines 224 and 226.

To retract cylinder rods 54, 72, while retaining cylinder rod 36 stationary, valve 204 is actuated to position 228 which reverses the hydraulic fluid flowpath just discussed with respect to extending the cylinder rods.

To extend cylinder rods 36, 54, 72 simultaneously, valve 204 is placed in position 208, valve 210 is placed in position 214, while valves 218 and 212 are opened to positions 220, 232 respectively. To retract cylinder rods 36, 54, 72, valve 204 is actuated to position 204, which reverses the hydraulic fluid flowpath.

As previously mentioned, the cylinder housing 18 can be moved within the socket 180 formed in the sliding door 144 (FIG. 4). To change the position of the cylinder housing 18 while cylinder rod 36 is extended and cylinder rods 56, 54 are retracted, valve 204 is actuated to position 228, valves 210 and 218 are actuated to open positions 234, 220, respectively, and valve 212 is closed to position 216. To change the position of the cylinder housing 18 if cylinder rod 36 is retracted and cylinder rods 54 and 72 are extended, valve 204 is actuated to position 208, valves 210 and 218 are opened to positions 234, 220 respectively, and valve 212 is closed to position 216.

The proceeding description has been presented with reference to a presently preferred embodiment to the invention shown in the drawings. Workers skilled in the art and technology to which this invention pertains will appreciate that alterations and changes in the described structure can be practiced without departing from the spirit, principals and scope of this invention.

What is claimed is:

1. For use in a door slidably mounted on support structure, a fluid cylinder assembly comprising:

an elongate, unitary housing having two pairs of opposing, substantially planar side walls enclosing first, second and third substantially parallel longitudinal bores adapted to receive pressurized fluid, said housing including removable end caps having a plurality of fluid passages interconnecting said bores for conveying said pressurized fluid to said bores substantially simultaneously;

first rod means displaceable within said first bore in response to fluid pressurization therein and extending through a first one of said end caps of said housing; and second and third rod means displaceable within said second and third bores in response to fluid pressurization therein and extending through a second one of said end caps at an opposite end of said housing, said rod means being positioned relative to each other in said housing such that extension of said rod means from said first and second end caps of said housing in response to said pressurization does not develop rotational torque on said housing, and said side walls are shaped to engage a recess formed in said door such that said housing and said cylinders are reinforced and provided with columnar strength thereby.

2. The assembly of claim 1 wherein said housing comprises a cylinder block and first and second end caps.

3. The assembly of claim 2 wherein said first rod means extends through a center of said first end cap.

4. The assembly of claim 3 wherein said second and third rod means extend through said second end cap and are positioned such that said first rod means is located between said second and third rod means.

5. The assembly of claim 4 further comprising a cylinder mount, said second and third rod means being connected to said mount.

6. The assembly of claim 5 wherein said mount extends about said housing and includes means for attachment to a supporting structure, said attachment means being positioned adjacent to said first end cap.

7. For use in a door slidably mounted on support structure, a fluid cylinder assembly comprising:

a cylinder block having first, second and third substantially parallel longitudinal bores adapted to receive pressurized fluid, and first and second end caps;

first rod means displaceable within said first bore in response to fluid pressurization and extending through a center of said first end cap;

second and third rod means displaceable within said second and third bores in response to fluid pressurization and extending through said second end cap, said second and third rod means positioned such that said first rod means is located between said second and third rod means, such that extension of said rod means from said first and second ends of said cylinder in response to said pressurization does not develop rotational torque on said cylinder and said rod means are capable of displacement along substantially an entire length of said cylinder;

a cylinder mount, said second and third rod means being connected to said mount, said mount extending about said cylinder and including means for attachment to a supporting structure said attachment means being positioned adjacent to said first end cap, and said mount including a center bar positioned adjacent to said second end cap, said second and third rod means being attached to said center bar.

8. The assembly of claim 7 wherein said cylinder and said mount are shaped to fit within a recess formed in an end of said door.

9. The assembly of claim 8 wherein said attachment means is attachable to said door adjacent said end thereof, whereby said assembly is removable from said recess by disconnecting said attachment means from said door.

10. The cylinder of claim 9 wherein said attachment means includes ears located on opposite sides of said mount, said ears attachable by pin to said door at said end thereof.

11. In a waste processing system having an enclosed chamber defined by support structure, a door assembly comprising:

a door slidably mounted on said support structure and including an end surface having a recess;

a fluid cylinder located within said recess, said fluid cylinder including a unitary housing having first rod means, extendable through a first end of said housing, and second and third rod means extendable through an opposite end of said housing; and a cylinder mount located within said recess for retaining said fluid cylinder within said recess and attachable to said door adjacent said end surface thereof, whereby said fluid cylinder and said mount is removable from said recess at said end surface.

12. The door assembly of claim 11 wherein said first rod means extends through a center of said first end of said housing.

13. The door assembly of claim 12 wherein said second and third rod means extend through said opposite end of said housing and are positioned such that said first rod means is located between said second and third rod means.

14. The door assembly of claim 13 wherein said second and third rod means are connected to said cylinder mount.

15. The door assembly of claim 14 wherein said mount includes means for attachment to said door, said attachment means positioned adjacent said end surface.

16. The door assembly of claim 15 wherein said mount includes a center bar positioned adjacent said housing opposite end; and said second and third rod means are attached to said center bar.

17. The door assembly of claim 16 wherein said attachment means includes ears located on opposite sides of said mount, said ears being attachable by pins to said door at said end surface thereof.

18. In a waste processing system having an enclosed chamber defined by support structure, a door assembly comprising:

a door mounted on said support structure and including an end surface having a recess;

a fluid cylinder located within said recess, said fluid cylinder including a unitary housing having first, second and third substantially parallel longitudinal bores adapted to receive pressurized fluid;

said fluid cylinder further having first rod means displaceable within said first bore in response to fluid pressurization and extending from a first end of said housing, and second and third rod means displaceable within said second and third bores in response to fluid pressurization and extending from an opposite end of said housing;

said rod means being positioned in said bores such that said first rod means extends through a center of said first housing, said second and third rod means extend from said opposite end and are positioned such that said first rod means is located between said second and third rod means; and a cylinder mount located within said recess for retaining said fluid cylinder within said recess and attachable to said door adjacent said end surface thereof;

said cylinder mount having attachment means including ears located on opposite sides of said mount, said ears attachable by pins to said door at said end surface thereof, whereby said fluid cylinder and said mount are removable from said recess by disconnecting said pins from said door.

19. The door assembly of claim 18 wherein said assembly further includes a cover plate positioned over said fluid cylinder and said cylinder mount.

20. The door assembly of claim 18 wherein said first, second and third rod means are displaceable along substantially the entire length of said housing.

* * * * *